US009671126B2

(12) United States Patent
Aragon et al.

(10) Patent No.: US 9,671,126 B2
(45) Date of Patent: Jun. 6, 2017

(54) APPARATUS FOR REDUCING AIR FLOW THROUGH AN OPENING BETWEEN ADJACENT ROOMS

(71) Applicants: Daniel Mark Aragon, Meridian, ID (US); Peter James Wachtell, Boise, ID (US)

(72) Inventors: Daniel Mark Aragon, Meridian, ID (US); Peter James Wachtell, Boise, ID (US)

(73) Assignee: COLD CHAIN, LLC, Boise, ID (US)

( * ) Notice: Subject to any disclaimer, the term of this patent is extended or adjusted under 35 U.S.C. 154(b) by 1120 days.

(21) Appl. No.: 13/827,957

(22) Filed: Mar. 14, 2013

(65) Prior Publication Data

US 2013/0273826 A1 Oct. 17, 2013

Related U.S. Application Data

(60) Provisional application No. 61/625,249, filed on Apr. 17, 2012.

(51) Int. Cl.

| | |
|---|---|
| ***F24F 13/20*** | (2006.01) |
| ***E06B 9/00*** | (2006.01) |
| ***E06B 11/00*** | (2006.01) |
| ***A47H 3/00*** | (2006.01) |
| ***A47H 1/00*** | (2006.01) |
| ***A47H 21/00*** | (2006.01) |
| ***A47H 23/00*** | (2006.01) |
| ***F24F 9/00*** | (2006.01) |
| ***F27D 5/00*** | (2006.01) |
| ***F24F 13/26*** | (2006.01) |
| ***F24F 7/06*** | (2006.01) |
| *F25D 13/06* | (2006.01) |

(52) U.S. Cl.

CPC ..... *F24F 13/20* (2013.01); *F24F 7/06* (2013.01); *F24F 13/26* (2013.01); *F25D 13/06* (2013.01)

(58) Field of Classification Search

None

See application file for complete search history.

(56) References Cited

U.S. PATENT DOCUMENTS 2,039,445 A * 5/1936 Parmelee ..... F27B 9/20 432/122
2,763,195 A * 9/1956 Caldwell ..... F24F 3/044 236/1 R (Continued)

*Primary Examiner* — Gregory Huson
*Assistant Examiner* — Eric Gorman
(74) *Attorney, Agent, or Firm* — MH2 Technology Law Group, LLP

(57) ABSTRACT

A system for maintaining thermal separation between first and second adjacent rooms or spaces. The system includes a vestibule with at least a first compartment, and other embodiments may include two or more compartments, such that the vestibule provides a passageway between the first and second rooms. At least one blower draws air from the first room through an air intake, and back into the first room through an exhaust. The system further includes an exhaust port from the first compartment in fluid communication with the exhaust, to exhaust air from the first compartment into the first room. During operation, a vacuum is formed within the first compartment that provides thermal separation between the first and second adjacent rooms.

12 Claims, 6 Drawing Sheets

(56) References Cited

U.S. PATENT DOCUMENTS

| | | | | | |
|---|---|---|---|---|---|
| 3,308,740 | A * | 3/1967 | Henson | F24F 9/00 | 454/188 |
| 3,690,118 | A * | 9/1972 | Rainwater | A47F 3/0447 | 62/237 |
| 3,744,963 | A * | 7/1973 | Flynn | F26B 13/10 | 266/111 |
| 4,133,636 | A * | 1/1979 | Flynn | F23G 7/065 | 34/513 |
| 4,270,283 | A * | 6/1981 | Ellis | F26B 13/10 | 34/212 |
| 4,449,921 | A * | 5/1984 | Catallo | F23G 7/065 | 432/59 |
| 4,587,927 | A * | 5/1986 | Beierling | B05B 15/1207 | 118/326 |
| 4,744,750 | A * | 5/1988 | Lingl, Jr. | F27B 9/021 | 432/137 |
| 5,131,841 | A * | 7/1992 | Smith | A21B 1/48 | 126/21 A |
| 5,992,173 | A * | 11/1999 | Joseph | A23L 3/3418 | 134/131 |
| 7,734,008 | B1 * | 6/2010 | Sanders | G01V 5/0016 | 378/198 |
| 2004/0242145 | A1 * | 12/2004 | Ohwada | F24F 9/00 | 454/191 |
| 2008/0245078 | A1 * | 10/2008 | Burn | A23L 3/362 | 62/60 |
| 2010/0119985 | A1 * | 5/2010 | Potterill | D04H 1/4209 | 432/8 |
| 2010/0273121 | A1 * | 10/2010 | Gleason | F27D 7/04 | 432/4 |
| 2015/0118632 | A1 * | 4/2015 | Liu | F27B 9/045 | 432/122 |
| 2015/0196049 | A1 * | 7/2015 | Lang | F25D 3/11 | 62/63 |

* cited by examiner

APPARATUS FOR REDUCING AIR FLOW THROUGH AN OPENING BETWEEN ADJACENT ROOMS

RELATED APPLICATIONS

This disclosure claims benefit of U.S. Provisional Patent Application No. 61/625,249, filed Apr. 17, 2012, the disclosure of which is hereby incorporated by reference in its entirety.

FIELD OF THE EMBODIMENTS

The present teachings relate to the field of environmentally controlled spaces and, more particularly, to efficient thermal, particulate, and/or humidity control of enclosure spaces used, for example, in industrial processes that require reducing the effect of environmental conditions and/or contamination from one processing stage to a subsequent stage when processing stages are performed in adjacent spaces.

BACKGROUND OF THE EMBODIMENTS

In many types of production processes, the processing and assembly of product occurs in separate enclosures, rooms, or spaces. Each room may have a different and distinct environment created to assist with an aspect of the manufacturing process itself or that is tailored for the specific processing stage performed in the particular room. As the product is created or processed, it may be transported from one room to an adjacent room using, for example, a conveyor belt that moves each product item separately or a forklift, hand truck, or cart that moves an entire production lot of product. Environmental conditions within each room may be controlled separately. For example, a first processing stage may occur within a first room at a relatively higher temperature and a second processing stage occurs within a second adjacent room at a relatively lower temperature. Other environmental conditions such as humidity, airborne particulates, etc., may also be controlled. When product is moved from the first room to the second room, environmental air typically moves from the first room to the second room along with the product. In many manufacturing processes this movement of air along with the product is undesirable and may create inefficiencies that increase costs and decrease production.

For example, in the food processing industry, product such as fruit and vegetables are heated and/or cooked during processing. The heating process may include immersion of the product in hot water, which increases the temperature and humidity of the air within the room. If the product is heated without immersion in water, the heated product may release moisture, thereby increasing the temperature and humidity of the air within the room. Once a food product has been heated and/or cooked, it is often transported to a different, cooler room to be flash frozen to avoid bacterial contamination and spoilage of the product.

At many food processing facilities, food cooking and/or packaging occurs in a food processing room and flash freezing and/or cold storage occurs in a flash freezer room (freezer) located immediately adjacent to the processing room. The product may be transported directly from the processing room to the freezer using a conveyor belt. The conveyor belt transports the product in bulk form or in boxes from the processing room, through a hole or opening, and into the freezer. During transport of the processed product, warm humid air from the processing facility is transported into the freezer along with the processed product.

Once in the freezer, the warm air from the processing room cools and water vapor may condense and freeze within the freezer thereby resulting in a rapid buildup of frost within the freezer space itself. To remove the frost buildup, a processing plant may schedule equipment shutdowns to allow maintenance personnel time to manually clear the frost buildup to prevent equipment failure, which decreases production and increases labor costs. Food processing plants can also use heat trace equipment to spot heat certain locations within freezer space to prevent frost buildup, which decreases cooling efficiency of the freezer and increases costs.

To maintain temperature separation between rooms, high velocity air may be directed across an opening. The high velocity air may be prevented from flowing into a cold space using air curtains. One drawback with this technology is that when an object such as a vehicle, production personnel, or the product itself passes through the air curtain, the high velocity air can be deflected off of the object and into the room, space, or enclosure (hereinafter, collectively, "room" or "enclosure space") that the air is meant to protect.

Additionally, strip curtains are often used by themselves in an attempt to minimize airflow from the production room into the freezer. While strip curtains alone may provide a passive method to decrease unwanted air flow from a production room into a freezer, they provide only a modest improvement in efficiency.

Thus prior technologies used to maintain thermal separation between adjacent rooms are inefficient and/or provide only a minimum improvement. Heat and/or humidity introduced within the freezer can be negated by increasing cooling, which increases demand on the cooling systems, can result in an increase in equipment failure and an increase in required maintenance, a decrease in production, and thus increases costs.

A method and structure for providing improved thermal separation, moisture separation, and/or particulate separation between adjacent rooms such as a processing room and a freezer would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a vestibule for reducing the flow of air between a first enclosure and a second enclosure can include at least a first compartment and a second compartment, a first partial barrier that separates the first enclosure from the first compartment, a second partial barrier that separates the first compartment from the second compartment, and a third partial barrier that separates the second compartment from the second enclosure. The vestibule can further include a blower configured to draw air from the first enclosure through a vestibule intake and to return the air to the first enclosure through a vestibule exhaust, and a first compartment exhaust port configured such that the blower draws air from the first compartment through the first compartment exhaust port and exhausts the air from the first compartment through the vestibule exhaust into the first enclosure.

In another embodiment of the present teachings, a method for maintaining thermal separation between a first enclosure and a second enclosure using a vestibule can include drawing air from the first enclosure through a vestibule intake using a blower, exhausting the air through a vacuum outlet and back into the first enclosure through a vestibule exhaust, and drawing air from a first compartment of the vestibule through a first compartment exhaust, through the vacuum outlet, and into the first enclosure through the vestibule exhaust, thereby forming a vacuum within the vestibule first compartment using the blower. The method can further include drawing air from a second compartment of the vestibule, through a first partial barrier that separates the first compartment from the second compartment, and into the first compartment using the blower, and drawing air from the second enclosure, through a second partial barrier that separates the second enclosure from the second compartment, and into the second compartment using the blower.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to exemplary embodiments of the present teachings, examples of which are illustrated in the accompanying drawings. Wherever possible, the same reference numbers will be used throughout the drawings to refer to the same or like parts. It is to be understood, however, that embodiments of the present teachings may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

For purposes of the present teachings, unless otherwise specified, the term "thermal separation" encompasses both complete and partial thermal separation between two enclosures, spaces, rooms, etc. While the present teachings are described below, generally, with reference to thermal separation, it will be understood that the present teachings may also be used to reduce the transfer of moisture from one room to another, as water vapor carries a significant component of thermal load in many cases. Further, particulate separation between rooms may be better maintained using an embodiment of the present teachings. In various embodiments of the present teachings, some mixing of air from a room with air from a second room may occur intentionally, for example within a vestibule first compartment as described below. Additionally, unless otherwise specified, the term "blower" encompasses blowers, fans, or any device that is capable of moving air from one location to another location.

Figure 1:
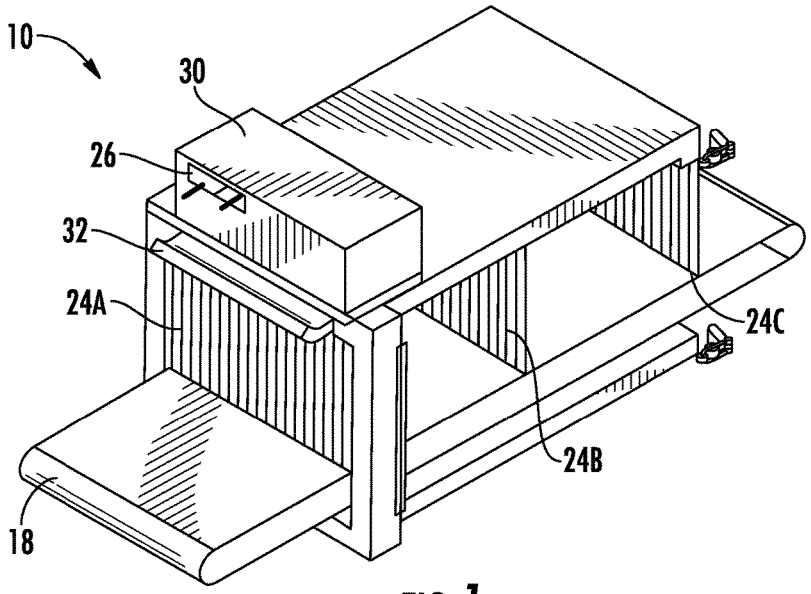
FIG. 1 is a perspective view.
Figure 2:
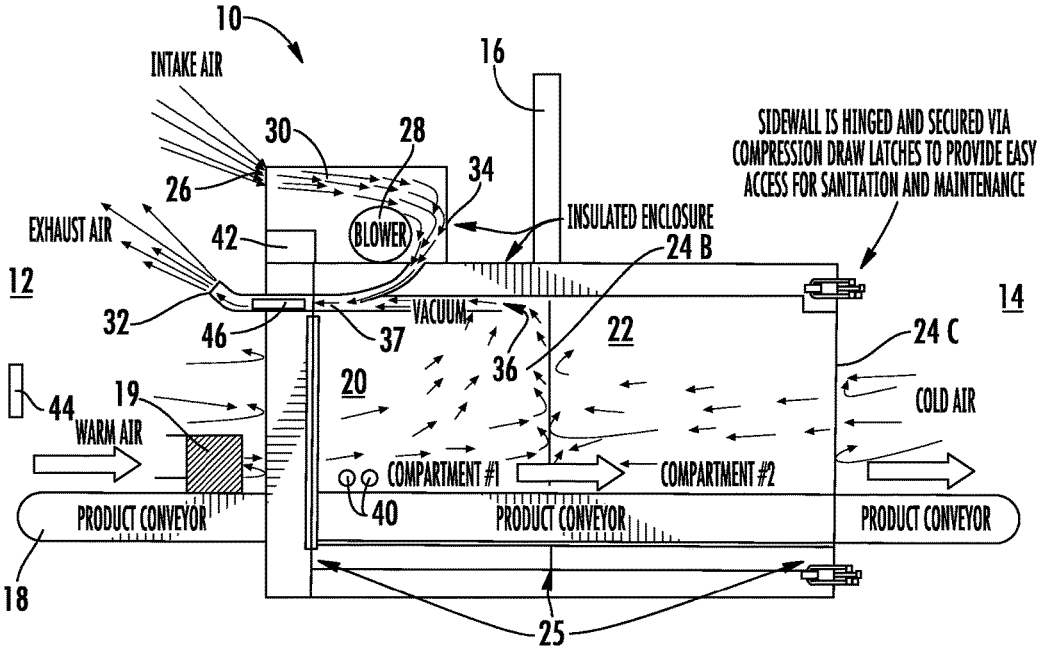
FIG. 2 is a cross section.
Figure 3:
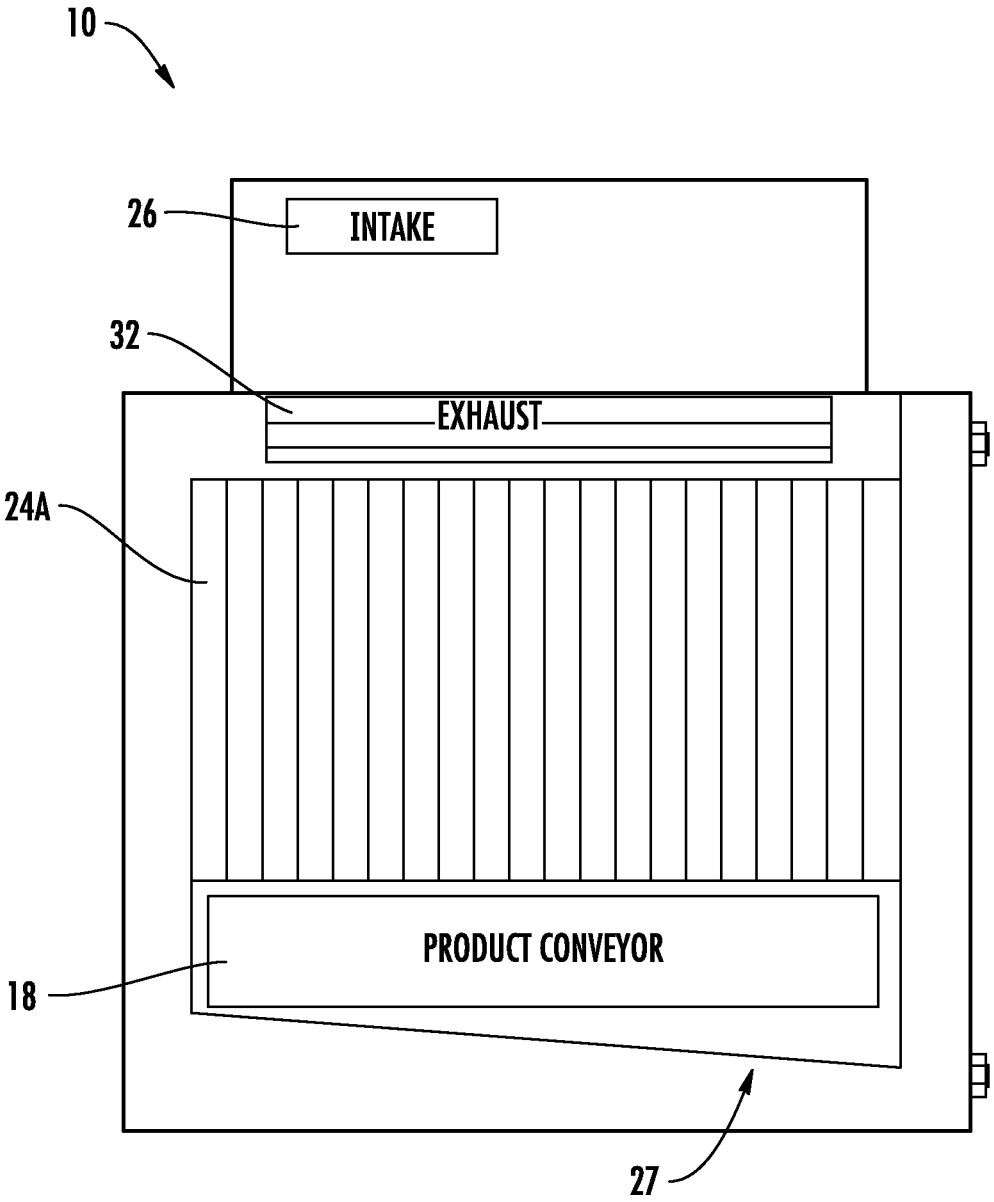
FIG. 3 is an end view of a structure in accordance with an embodiment of the present teachings, wherein the structure includes a vestibule used to thermally separate a first room or area from a second room or area.

A vestibule 10 in accordance with an embodiment of the present teachings is depicted in the perspective view of FIG. 1, the cross section of FIG. 2, and the end view of FIG. 3. The vestibule 10 may provide an opening, door, or passageway between a first room or space 12 (hereinafter, collectively, a "room") and a second room 14 separated by a wall 16. In an embodiment, the first room 12 is a processing room maintained at a relatively higher temperature and the second room 14 is a freezer maintained at a relatively lower temperature. In an embodiment, a product conveyor belt 18 may move product 19 from the first room 12 to the second room 14. In another embodiment, production personnel may move product from the first room 12 to the second room 14 using, for example, a forklift, a hand truck, etc.

The vestibule 10 may include an enclosed space including at least a first compartment or airlock 20 and a second compartment or airlock 22 provided between the first room 12 and the second room 14 that assists in maintaining thermal separation between the first room 12 and the second room 14 as described below. In an embodiment, a plurality of barriers may be employed to assist in thermally separating the first room 12 from the second room 14. The barriers 24A, 24B, 24C, as depicted in FIGS. 1-3, may include, for example, rubber, plastic, or fabric flaps or strip curtains or any other suitable type of barrier. The barriers are partial barriers, as some air flow through each of the barriers is desirable; however, each barrier reduces the flow of air between compartments or enclosures compared to if the barrier was absent.

In an embodiment, barrier 24A separates the first room 12 from the first compartment 20, barrier 24B separates the first compartment 20 from the second compartment 22, and barrier 24C separates the second compartment 22 from the second room 14. Thus the barriers 24A-24C separate the first room 12 from the second room 14. In an embodiment, an area underneath conveyor belt 18 can include seals 25 to further reduce airflow. The seals 25 can be positioned as desired, such as in proximate vertical alignment with the barriers 24A, 24B and/or 24C. As depicted in FIG. 3, the vestibule 10 may also include a sloped floor 27 under the conveyor to facilitate improved cleaning and sanitation.

In an embodiment, the vestibule 10 includes subassemblies as described below that maintain the environments within the first compartment 20 and the second compartment 22. In this embodiment, the environment of the first compartment 20 is actively maintained to emulate the environment of the first room 12, and the environment of the second compartment 22 is passively maintained to emulate the environment of the second room 14.

The vestibule 10 includes a vestibule intake 26 that takes air into the vestibule from the first room 12, a blower 28 such as a centrifugal fan housed within a blower box 30, and vestibule exhaust 32 that exhausts air from the vestibule into the first room 12. The vestibule 10 further includes ductwork with a blower box exhaust port 34 that exits out of, and exhausts air from, the blower box 30. The vestibule 10 further includes a first compartment exhaust port 36 in fluid communication with the blower box exhaust port 34 that opens into, and exhausts air from, the first compartment 20. The blower box exhaust port 34 and first compartment exhaust port 36 are in fluid communication with a vacuum outlet 37 that leads to the vestibule exhaust 32. The sizes and shapes of the vestibule intake 26, the blower 28, the blower box exhaust port 34, first compartment exhaust port 36, and vestibule exhaust 32 are matched or sized such that, during operation, the blower 28 creates a vacuum within the first compartment 20 as described below.

In operation, the blower 28 draws air from the first room 12 through the vestibule intake 26 and into the blower box 30. Further, the blower 28 directs air out of the blower box 30 through the blower box exhaust port 34 and back into the first room 12 through the vestibule exhaust 32. Because the first compartment exhaust port 36 that opens into the first compartment 20 is in fluid communication with the blower box exhaust port 34, a vacuum is created within the first compartment exhaust port 36 and within the first compartment 20 resulting from Bernoulli and/or Venturi effects. A controlled volume of air is also drawn from the second room 14 through the third barrier 24C and the second barrier 24B, and into the first compartment 20, which is then exhausted back into the first room 12 through vestibule exhaust 32. This maintains a balanced pressure differential between the first room 12 and the second room 14 that maintains thermal separation between the two rooms.

During operation, the vacuum within the first compartment 20 may draw air through the first barrier 24A and, in turn, from the first compartment 20 to the second compartment 22 and into the second room 14, which would reduce efficiency. To reduce or prevent this, perforations 40 may be formed in the sides and/or or top of the vestibule 10 at the first compartment 20, thus reducing the overall vacuum forces on the first barrier 24A and the flow of air mass between the first room 12 and the second room 14.

Further, if vacuum forces within the first compartment 20 are excessively strong, excessive air from the second room 14 can be drawn into the vestibule 10, thus reducing efficiency. It is desirable that some air is drawn by the vacuum in the first compartment 20 from the second room 14 and into the second compartment 22, with minimal air from the second compartment 22 moving through the second barrier 24B and into the first compartment 20. Conversely, if the vacuum forces within the first compartment 20 are too weak, the air flow through the first compartment 20 will not be sufficient which can result in increased air flow from the first room 12 through the vestibule 10 to the second room 14.

In an embodiment, the apparatus of the present disclosure can include a means for varying the vacuum force within the vestibule 10. In an embodiment, the blower 28 can include a variable speed blower controlled by a blower controller 42. The blower controller 42 is electrically coupled with the blower 28, and is configured to drive the blower 28 at any number of selected speeds. The vacuum forces within the first compartment 20 are proportional to blower 28 speed. In another embodiment, the speed of the blower 28 can be controlled manually by an operator. In either embodiment, the blower speed is controlled so that a sufficient amount of air is moved through the first compartment 20 and that a sufficient but not excessive amount of air is drawn from the second room 14 through the second barrier 24B and into the first compartment 20.

In an embodiment, two or more temperature sensors in communication with the blower controller 42 may be employed to automatically adjust the speed of the blower 28. A first temperature sensor 44 may be placed within the first room 12 and a second temperature sensor 46 may be placed within the vacuum outlet 37 that leads to the vestibule exhaust 32. The blower controller 42 receives first temperature information relative to the first room from the first temperature sensor 44 and receives second temperature information relative to the vacuum outlet 37 from the second temperature sensor 46, for example through a wired or wireless connection. Based on a temperature differential between the first temperature and the second temperature, the blower controller 42 adjusts the speed of the blower 28. A temperature differential that is too large would indicate that the vacuum within the first compartment 20 is too great, and that excessive air is being drawn into the first compartment 20 from the second room 14. A temperature difference that is too small would indicate that the vacuum within the first compartment 20 is too small, and that insufficient air is being drawn into the second compartment 22 from the second room 14 by the vacuum in the first compartment 20. The blower controller 42 would be programmed to maintain a constant desired temperature differential between the first temperature sensor 44 and the second temperature sensor 46.

The vestibule 10 can be scaled for any desired size. For example, the vestibule 10 can be sized for transporting a smaller product 19 from the first room 12, through the first barrier 24A to the first compartment 20 within the vestibule 10, through the second barrier 24B to the second compartment 22, and through the third barrier 24C to the second room 14 using, for example, a conveyor belt 18. The vestibule 10 may also be scaled to a larger size so that production personnel can move the product 19 through the vestibule 10 from the first room 12 to the second room 14 using, for example, a forklift, hand truck, cart, or other transport. The system according to various embodiments of the present teachings is well suited for any size or type of opening where reducing airflow between two rooms or spaces is beneficial.

It will be understood that the FIGS. are schematic views and that a vestibule 10 in accordance with the present teachings can include other elements that are not depicted for simplicity and that other depicted elements can be removed or modified.

In another embodiment, a vestibule can include a single compartment. This embodiment can include the various elements as depicted in FIGS. 1-3, for example, in which the second compartment 22 and the third barrier 24C are omitted. The compartment 20 can include first barrier 24A and second barrier 24B. Once a product 19 is transported from compartment 20 through the second barrier 24B, it enters the second room 14. The blower 28 draws air from the first room 12 through the vestibule intake 26, into the blower compartment 30, and exhausts the air back into the first room 12 through the vestibule exhaust 32 to maintain thermal, moisture, and/or particulate separation of the first room 12 and the second room 14.

Figure 4:
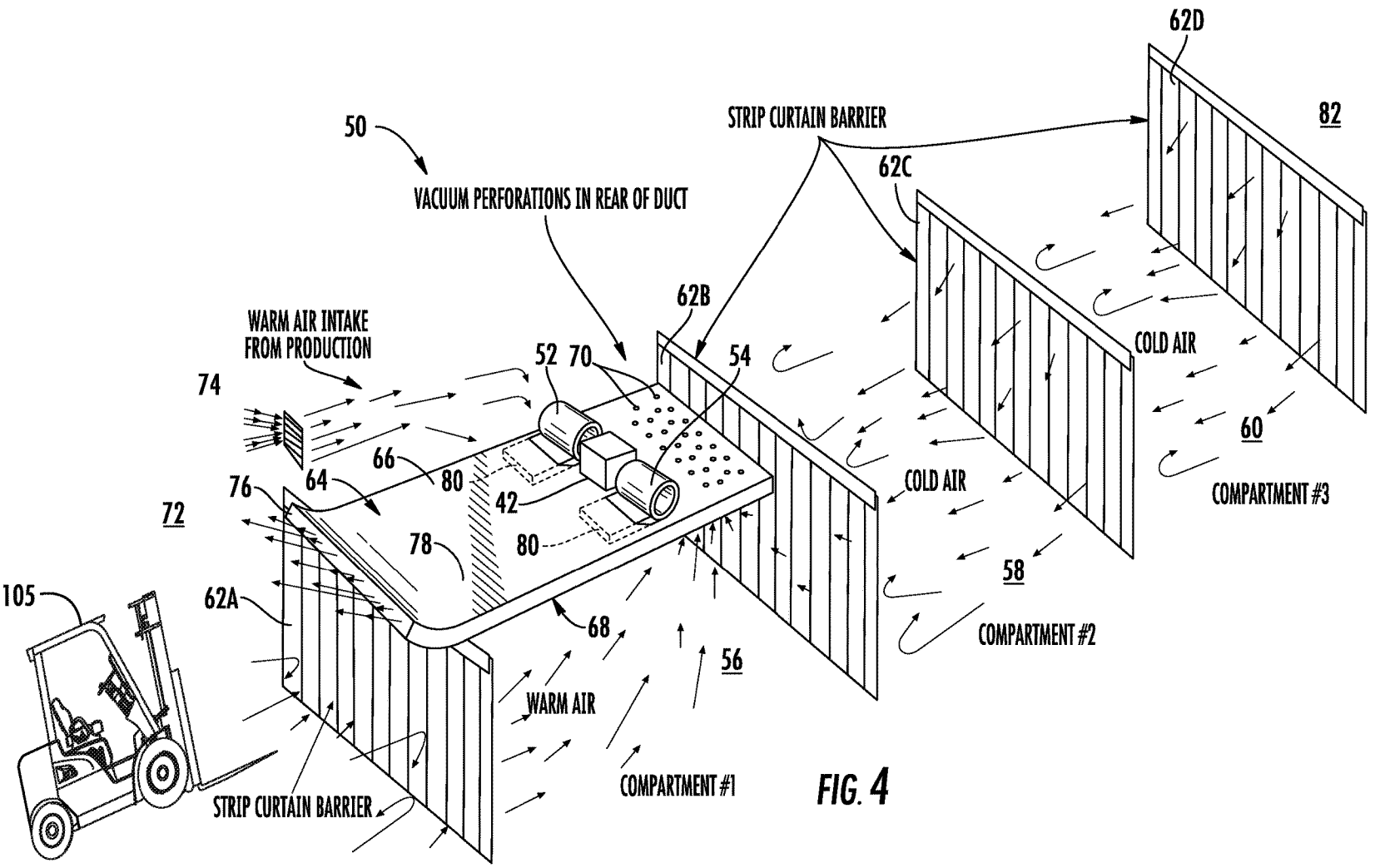
FIG. 4 is a schematic perspective depiction of a vestibule according to another embodiment of the present teachings.

FIG. 4 is a schematic perspective view depicting another vestibule 50 embodiment including a first blower 52, a second blower 54, a first compartment (e.g., airlock) 56, a second compartment 58, a third compartment 60, a first barrier 62A, a second barrier 62B, a third barrier 62C, and a fourth barrier 62D. The blowers 52, 54 are placed on a top surface 64 of a hollow duct platform 66. A bottom surface 68 of the hollow duct platform 66, which forms a ceiling across an entire width of the first compartment 56, includes a plurality of perforations 70 at a location proximate to the second barrier 62B. The perforations 70, which provide a first compartment exhaust port, are located only toward the rear of the duct platform 66 behind the blowers 52, 54. The perforations 70 are not located forward of the blowers 52, 54 to prevent air inside of the duct platform from being blown back into the first compartment 56.

In operation, the vestibule 50 functions similar to the embodiments described above. Air is drawn by the blowers 52, 54 from a first room 72 through a vestibule intake 74, and is transported through the hollow duct platform 66 and out of an end of the duct platform 66 which forms a vestibule exhaust 76, then back into the first room 72. Through Bernoulli and/or Venturi effects, air is drawn from the first compartment 56 through the perforations 70 in the bottom surface 68 of the duct platform 66 by the blowers 52, 54. The hollow duct platform provides a vacuum outlet 78 in fluid communication with the perforations 70 and blower box exhaust ports 80. A vestibule 50 including three separate compartments 56, 58, 60, may have improved thermal efficiency over a vestibule 10 that has two compartments 20, 22, but uses additional materials and physical space. The vestibule 50 maintains thermal separation between the relatively warmer first room 72 and a relatively cooler second room 82. The vestibule may include a blower controller 42 and temperature sensors (not individually depicted) that output temperature information to the blower controller 42 in accordance with embodiments of the present teachings discussed above. In an embodiment, instead of three compartments the vestibule 50 includes only the two compartments 56 and 58.

Figure 7:
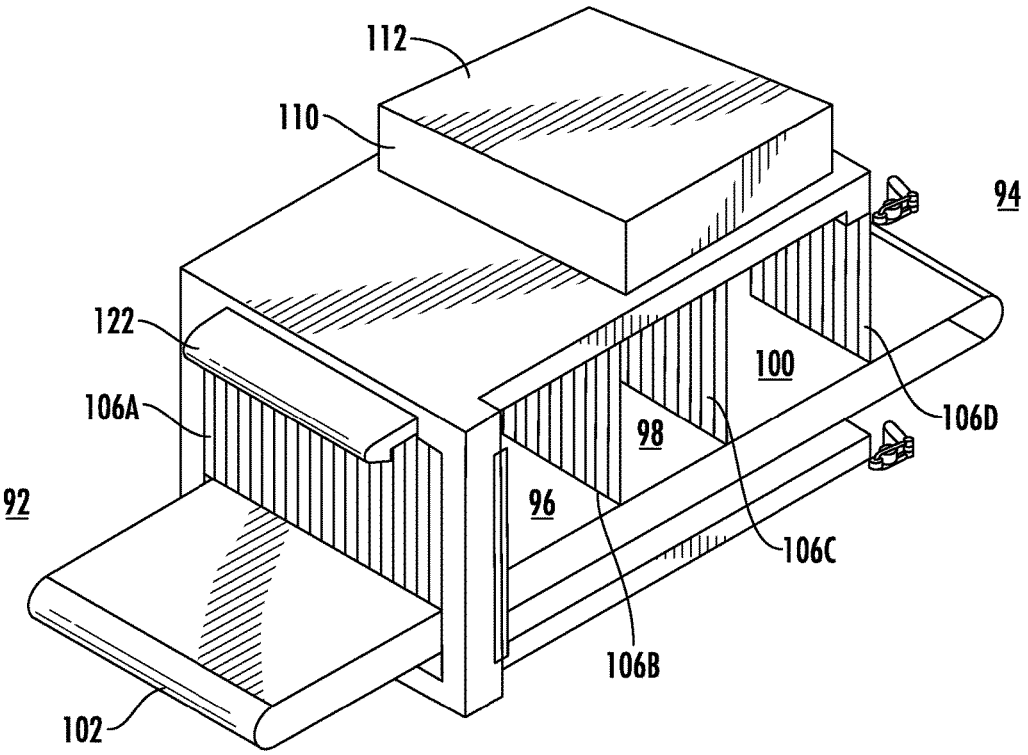
FIG. 7 is a perspective view.
Figure 8:
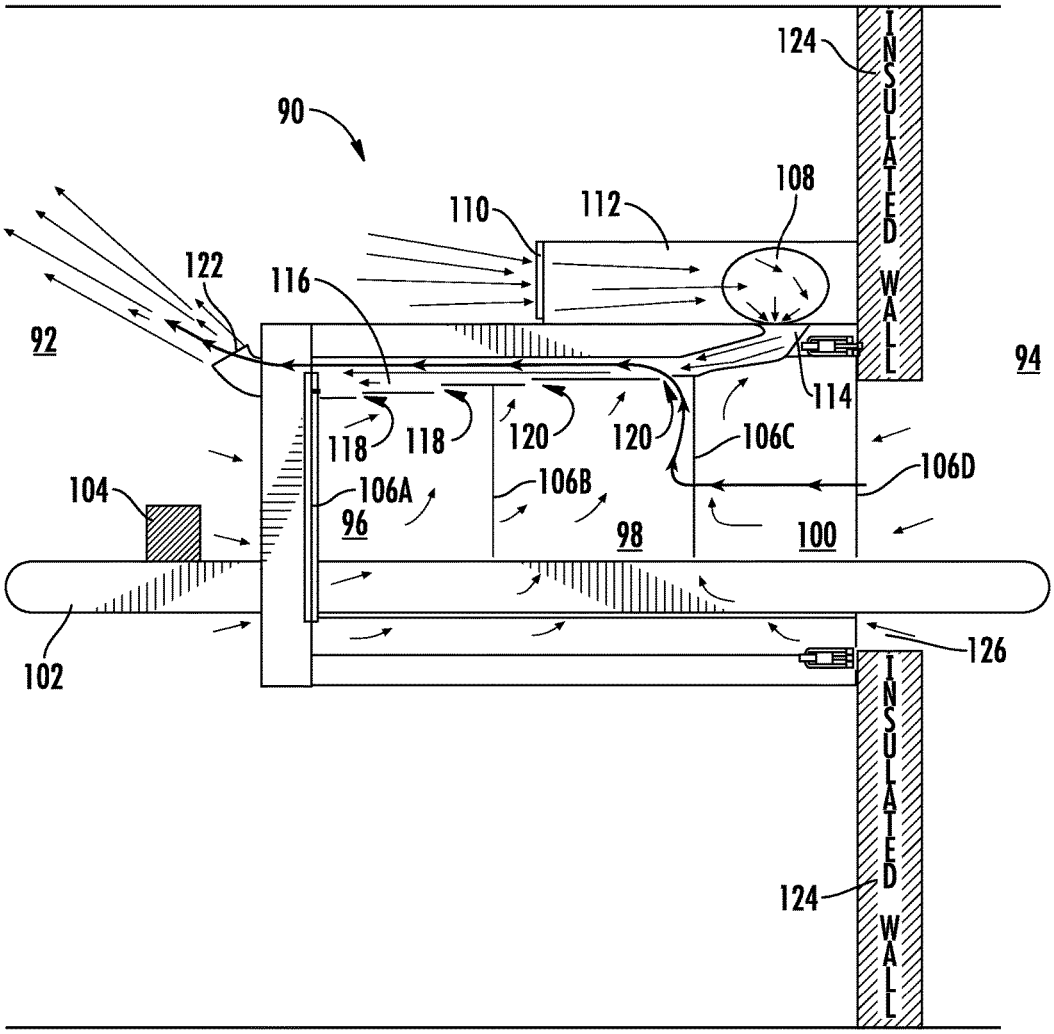
FIG. 8 is a cross section, depicting a vestibule according to another embodiment of the present teachings.

FIG. 7 is a perspective view, and FIG. 8 is a cross section, depicting a vestibule 90 according to another embodiment of the present teachings. In this embodiment, a first room 92, for example a relatively warmer room at ambient temperature, is separated from a second room 94, for example a relatively cooler room below freezing, by vestibule 90. The vestibule 90 includes a first compartment 96, a second compartment 98, and a third compartment 100. A product conveyor belt 102 may be used to move a product 104 from the first room 92, through a first partial barrier 106A into the first compartment 96, through a second partial barrier 106B into the second compartment 98, through a third partial barrier 106C into the third compartment 100, and through a fourth partial barrier 106D into the second room 94. In another embodiment, the vestibule can be scaled to move product 104 through a similar path using, for example, a forklift 105 (as shown in FIG. 4), a hand truck, etc.

In this embodiment, a blower 108 draws air from the first room 92 through a vestibule intake 110 into a blower box 112, out of the blower box 112 through a blower box exhaust port 114, and through a vacuum outlet 116. The blower box exhaust port 114 and the vacuum outlet 116 are in fluid communication with at least one first compartment exhaust port 118 and at least one second compartment exhaust port 120. As air is forced through the vacuum outlet 116 by the blower 108, air is drawn from the first compartment 96 through the first compartment exhaust port 118 and from the second compartment 98 through the second compartment exhaust port 120 through Venturi and/or Bernoulli forces, and into the first room 92 through vestibule exhaust 122. As depicted in FIG. 8, the blower 108 is configured to bypass the third compartment 100 such that the blower 108 does not return air from the third compartment 100 to the first room 92 through a third compartment exhaust port 120. While the blower is configured to bypass the third compartment 100, some air from the third compartment 100 may be drawn by vacuum generated by the blower 108 within the second compartment 98 and through the third partial barrier 106C. This air enters the second compartment 98 where it may be drawn through the second compartment exhaust port 120, through the vacuum outlet 116, and into the first room 92 through the vestibule exhaust 122. While some air is thus drawn from the second room 94 into the first room 92 through this effect, the net effect is to better maintains thermal, moisture, and particulate separation between the first room 92 and the second room 94 than conventional systems.

In this embodiment, the first room 92 can be separated from the second room by an insulated wall 124. Further, cold air is drawn from second room 94, through the fourth partial barrier 106, and into the third compartment 100. As this occurs, some cold air is drawn through a gap 126 between the insulated wall 124 and the conveyer belt 102, and across product 104 being transported through the third compartment 100. This pre-cools the product 104 within the third compartment 100 before it enters the second room 94, and may thereby further increase thermal efficiency.

Simulation Example

Figure 5:
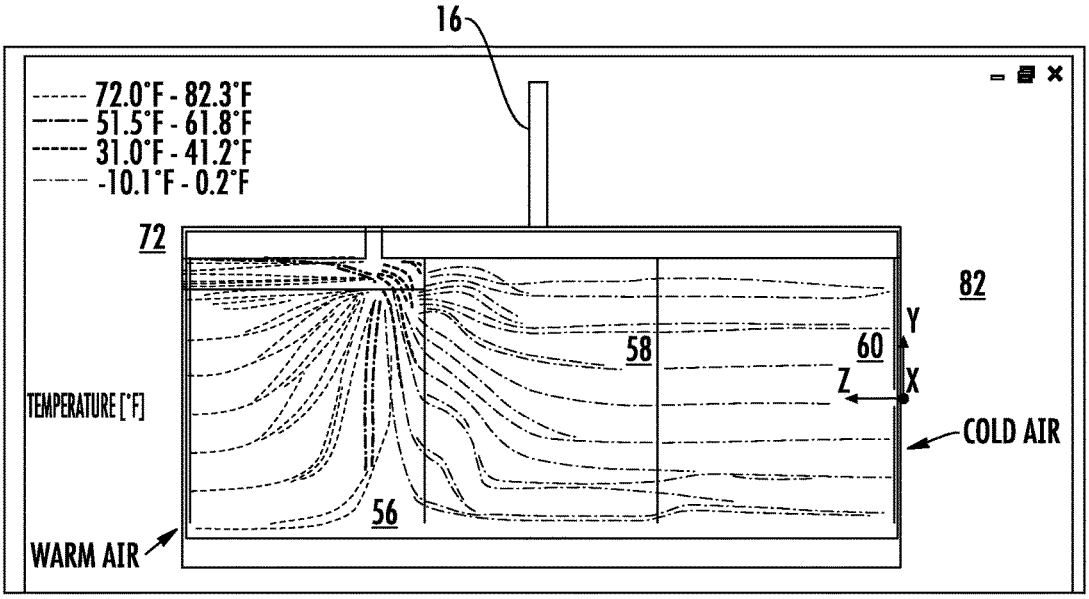
FIG. 5 is a cross section of a simulated vestibule in accordance with an embodiment of the present teachings depicting simulated thermal airflow characteristics.
Figure 6:
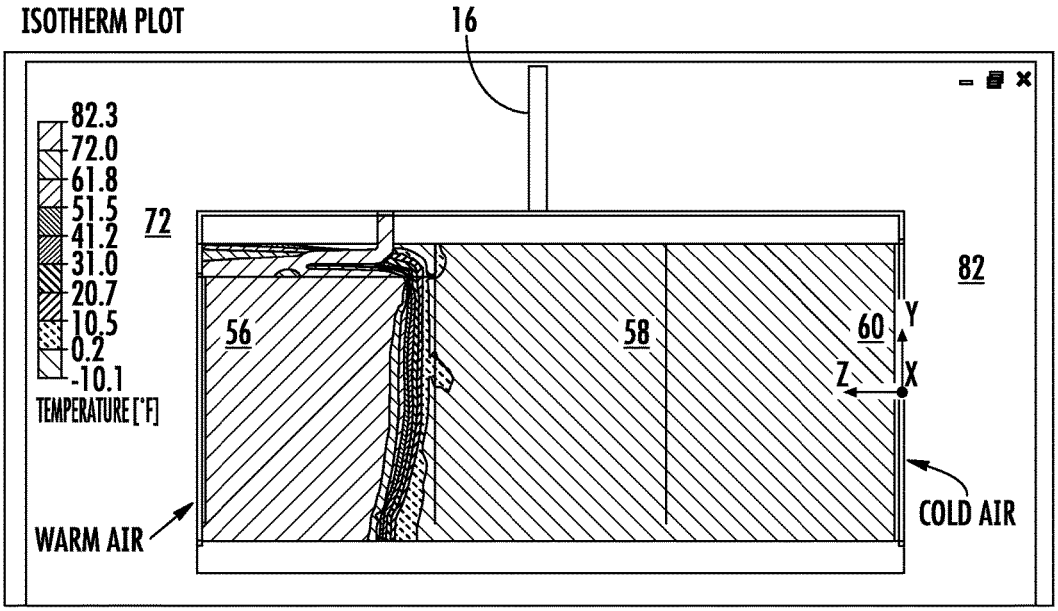
FIG. 6 is a cross section of a simulated vestibule in accordance with an embodiment of the present teachings depicting simulated isotherm characteristics.

A thermal simulation of an apparatus including a three compartment vestibule such as that depicted in FIG. 4 was performed, with results depicted in the thermal plots of FIGS. 5 and 6. The thermal plots of FIGS. 5 and 6 are approximations of data plots which may be found in the provisional application and in the informal FIGS. as filed.

FIG. 5 demonstrates that relatively warmer air is drawn in from a warmer room 72 at the left side of FIG. 5, and that relatively cooler air is drawn in from a cooler room 82 at the right side of the FIG. 5. The vestibule maintains a balanced pressure differential between the warmer room 72 and the cooler room 82, thereby maintaining a cooler temperature within compartments 58, 60, and a warmer temperature within compartment 56. In turn, this maintains thermal separation between the warmer room 72 and the cooler room 82 at the right of FIG. 5.

FIG. 6 depicts a simulated isotherm plot of a three compartment vestibule such as that depicted in FIG. 4. The isotherm plot demonstrates that good thermal separation is maintained between the first compartment 56 and the second compartment 58, and thus good thermal separation would be maintained between the relatively warmer room 72 and the relatively cooler room 82.

While the present teachings have been described in connection with the above-referenced embodiments, this description is not intended to limit the scope of the present teachings to the particular form set forth herein. On the contrary, the present teachings are intended to cover such alternatives, modifications, and equivalents as may be included within the spirit and scope of the present teachings as defined by the appended claims. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of"

is used to mean one or more of the listed items can be selected. Additionally, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. Other embodiments of the present teachings will be apparent to those skilled in the art from consideration of the specification and practice of the disclosure herein.

The invention claimed is:

1. A vestibule for reducing the flow of air between a first enclosure space and a second enclosure space, comprising:

a compartment between the first enclosure space and the second enclosure space, the first enclosure space being a food processing room at a first temperature and the second enclosure space being at a second temperature that is cooler than the first temperature;

an opening between the compartment and the second enclosure space;

a partial barrier within the opening, wherein the partial barrier separates the compartment from the second enclosure space;

a blower configured to draw air from the first enclosure space through a vestibule intake and to return the air to the first enclosure space through a vestibule exhaust; and a compartment exhaust port configured such that the blower draws air from the compartment through the compartment exhaust port and exhausts the air from the compartment through the vestibule exhaust into the first enclosure space.

2. The vestibule of claim 1, further comprising:

the compartment is a first compartment and the vestibule further comprises a second compartment between the first compartment and the second enclosure space;

the partial barrier is a first partial barrier between the first compartment and the second compartment and the vestibule further comprises a second partial barrier between the second compartment and the second enclosure space;

the compartment exhaust port is a first compartment exhaust port and the vestibule further comprises a second compartment exhaust port configured such that the blower draws air from the second compartment through the second compartment exhaust port and exhausts the air from the second compartment through the vestibule exhaust into the first enclosure space.

3. The vestibule of claim 2, further comprising a blower box that houses the blower, wherein the blower box comprises a blower box exhaust port in fluid communication with the first compartment exhaust port, the second compartment exhaust port, and the vestibule exhaust.

4. The vestibule of claim 2, further comprising:

a third compartment between the second compartment and the second enclosure space;

the second partial barrier is between the second compartment and the third compartment;

a third partial barrier between the third compartment and the second enclosure space;

a fourth partial barrier between the first enclosure space and the first compartment; and the blower is configured to bypass the third compartment.

5. The vestibule of claim 4, further comprising:

a blower box that houses the blower, wherein the blower box comprises a blower box exhaust port in fluid communication with the first compartment exhaust port, the second compartment exhaust port, and the vestibule exhaust; and a vacuum outlet in fluid communication with the first compartment exhaust port, the second compartment exhaust port, and the blower box exhaust port.

6. The vestibule of claim 5, further comprising:

a blower controller configured to control a speed of the blower;

a first temperature sensor within the first enclosure space in electrical communication with the blower controller; and a second temperature sensor within the vacuum outlet in electrical communication with the blower controller, wherein the blower controller is configured to set a blower speed based on a temperature differential of a temperature detected in the first enclosure by the first temperature sensor and a temperature detected in the vacuum outlet by the second temperature sensor.

7. The vestibule of claim 5, wherein the blower is configured to draw air from the second enclosure space into the third compartment through the third partial barrier, across a product within the third compartment to pre-cool the product within the third compartment, through the second partial barrier, into the second compartment, through the second compartment exhaust port, through the vacuum outlet, and into the first enclosure space through the vestibule exhaust.

8. A vestibule for reducing the flow of air between a first enclosure space and a second enclosure space, comprising:

a compartment between the first enclosure space and the second enclosure space, the first enclosure space being at a first temperature and the second enclosure space being at a second temperature that is cooler than the first temperature;

an opening between the compartment and the second enclosure space;

a partial barrier within the opening, wherein the partial barrier separates the compartment from the second enclosure space;

a blower configured to draw air from the first enclosure space through a vestibule intake and to return the air to the first enclosure space through a vestibule exhaust; and a compartment exhaust port configured such that the blower draws air from the compartment through the compartment exhaust port and exhausts the air from the compartment through the vestibule exhaust into the first enclosure space, the compartment is a first compartment and the vestibule further comprises a second compartment between the first compartment and the second enclosure space;

the partial barrier is a first partial barrier between the first compartment and the second compartment and the vestibule further comprises a second partial barrier between the second compartment and the second enclosure space;

the compartment exhaust port is a first compartment exhaust port and the vestibule further comprises a second compartment exhaust port configured such that the blower draws air from the second compartment through the second compartment exhaust port and exhausts the air from the second compartment through the vestibule exhaust into the first enclosure space, and further comprising a hollow duct platform comprising a top surface that supports the blower and a bottom surface comprising a plurality of perforations therein that form the first compartment exhaust port.

9. A vestibule for reducing the flow of air between a first enclosure space and a second enclosure space, comprising:

a compartment between the first enclosure space and the second enclosure space, the first enclosure space being at a first temperature and the second enclosure space being at a second temperature that is cooler than the first temperature;

an opening between the compartment and the second enclosure space;

a partial barrier within the opening, wherein the partial barrier separates the compartment from the second enclosure space;

a blower configured to draw air from the first enclosure space through a vestibule intake and to return the air to the first enclosure space through a vestibule exhaust; and a compartment exhaust port configured such that the blower draws air from the compartment through the compartment exhaust port and exhausts the air from the compartment through the vestibule exhaust into the first enclosure space;

the compartment is a first compartment and the vestibule further comprises a second compartment between the first compartment and the second enclosure space;

the partial barrier is a first partial barrier between the first compartment and the second compartment and the vestibule further comprises a second partial barrier between the second compartment and the second enclosure space;

the compartment exhaust port is a first compartment exhaust port and the vestibule further comprises a second compartment exhaust port configured such that the blower draws air from the second compartment through the second compartment exhaust port and exhausts the air from the second compartment through the vestibule exhaust into the first enclosure space, a third compartment between the second compartment and the second enclosure space;

the second partial barrier is between the second compartment and the third compartment;

a third partial barrier between the third compartment and the second enclosure space;

a fourth partial barrier between the first enclosure space and the first compartment; and the blower is configured to bypass the third compartment, and each of the first, second, third and fourth partial barriers comprises strip curtains.

10. The vestibule of claim 4, further comprising a conveyor belt configured to transport a product from the first enclosure through the first partial barrier into the first compartment, from the first compartment through the second partial barrier into the second compartment, and from the second compartment through the third partial barrier into the second enclosure.

11. A vestibule for reducing the flow of air between a first enclosure space and a second enclosure space, comprising:

a compartment between the first enclosure space and the second enclosure space, the first enclosure space being at a first temperature and the second enclosure space being at a second temperature that is cooler than the first temperature;

an opening between the compartment and the second enclosure space;

a partial barrier within the opening, wherein the partial barrier separates the compartment from the second enclosure space;

a blower configured to draw air from the first enclosure space through a vestibule intake and to return the air to the first enclosure space through a vestibule exhaust; and a compartment exhaust port configured such that the blower draws air from the compartment through the compartment exhaust port and exhausts the air from the compartment through the vestibule exhaust into the first enclosure space, the compartment is a first compartment and the vestibule further comprises a second compartment between the first compartment and the second enclosure space;

the partial barrier is a first partial barrier between the first compartment and the second compartment and the vestibule further comprises a second partial barrier between the second compartment and the second enclosure space;

the compartment exhaust port is a first compartment exhaust port and the vestibule further comprises a second compartment exhaust port configured such that the blower draws air from the second compartment through the second compartment exhaust port and exhausts the air from the second compartment through the vestibule exhaust into the first enclosure space, a third compartment between the second compartment and the second enclosure space;

the second partial barrier is between the second compartment and the third compartment;

a third partial barrier between the third compartment and the second enclosure space;

a fourth partial barrier between the first enclosure space and the first compartment; and the blower is configured to bypass the third compartment, and the first second, and third partial barriers are scaled for movement of a product from the first enclosure through the first partial barrier into the first compartment, from the first compartment through the second partial barrier into the second compartment, and from the second compartment through the third partial barrier into the second enclosure using a forklift.

12. A vestibule for reducing the flow of air between a first enclosure space and a second enclosure space, comprising:

a compartment between the first enclosure space and the second enclosure space, the first enclosure space being at a first temperature and the second enclosure space being at a second temperature that is cooler than the first temperature;

an opening between the compartment and the second enclosure space;

a partial barrier within the opening, wherein the partial barrier separates the compartment from the second enclosure space;

a blower configured to draw air from the first enclosure space through a vestibule intake and to return the air to the first enclosure space through a vestibule exhaust; and a compartment exhaust port configured such that the blower draws air from the compartment through the compartment exhaust port and exhausts the air from the compartment through the vestibule exhaust into the first enclosure space, the compartment is a first compartment and the vestibule further comprises a second compartment between the first compartment and the second enclosure space;

the partial barrier is a first partial barrier between the first compartment and the second compartment and the vestibule further comprises a second partial barrier between the second compartment and the second enclosure space;

the compartment exhaust port is a first compartment exhaust port and the vestibule further comprises a second compartment exhaust port configured such that the blower draws air from the second compartment through the second compartment exhaust port and exhausts the air from the second compartment through the vestibule exhaust into the first enclosure space, and wherein the second enclosure space is a freezer.

* * * * *